US006604940B2

(12) United States Patent
Pappas

(10) Patent No.: US 6,604,940 B2
(45) Date of Patent: Aug. 12, 2003

(54) ASSEMBLING CANDLE WICK IN SUSTAINER

(75) Inventor: George G Pappas, Norwich, OH (US)

(73) Assignee: Lumi-Lite Candle Company, Inc., Norwich, OH (US)

( * ) Notice: Subject to any disclaimer, the term of this patent is extended or adjusted under 35 U.S.C. 154(b) by 0 days.

(21) Appl. No.: 09/966,248

(22) Filed: Sep. 28, 2001

(65) Prior Publication Data

US 2003/0064339 A1 Apr. 3, 2003

(51) Int. Cl.[7] ..... F23D 3/18

(52) U.S. Cl. ..... 431/298; 431/33; 431/291; 431/320

(58) Field of Search ..... 431/288, 289, 431/291, 292, 298, 35, 33, 320

(56) References Cited

U.S. PATENT DOCUMENTS 5,842,850 A * 12/1998 Pappas ..... 431/291

5,961,318 A * 10/1999 Chambers et al. ..... 431/291

FOREIGN PATENT DOCUMENTS

GB 2603 * 2/1909 ..... 431/291

* cited by examiner

*Primary Examiner*—James C. Yeung
(74) *Attorney, Agent, or Firm*—Frank H. Foster; Kremblas, Foster, Phillips & Pollick

(57) ABSTRACT

A method for mounting a wick within a wick sustainer is disclosed. The sustainer has a base, a barrel and a passage that extends through the sustainer. The passage has an upper region occupied by the wick and a lower region occupied, at least partially, by the sealant. Sealing the lower region of the passage is accomplished by injecting the sealant into the passage, thereby preventing the fuel from contacting the portion of the wick that is retained in the upper region of the passage. Fuel reaches the flame of the burning wick only through the portion of wick not held in the sustainer, so the flame is extinguished once the fuel descends below the top of the sustainer.

9 Claims, 4 Drawing Sheets

ASSEMBLING CANDLE WICK IN SUSTAINER

CROSS-REFERENCES TO RELATED APPLICATIONS (Not Applicable)

STATEMENT REGARDING FEDERALLY-SPONSORED RESEARCH AND DEVELOPMENT (Not Applicable)

REFERENCE TO A "MICROFICHE APPENDIX"

(Not Applicable)

BACKGROUND OF THE INVENTION

1. Field of the Invention

This invention relates generally to candles, and more specifically to a method of sealing a candle wick sustainer.

2. Description of the Related Art

During the end stages of candle burning, fire hazards arise from the build-up of excessive heat in the candle interior. A candle is one or more combustible wicks supported by a material that constitutes a fuel, which is solid, semi-solid, or quasi-rigid at room temperature, 68 degrees Fahrenheit to 80 degrees Fahrenheit (20 degrees Celsius to 26 degrees Celsius); it can also contain additives which are used for color, odor, stability, or to modify the burning characteristics; the combined function of which is to sustain a light-producing flame. Candles burn a fuel and produce a flame that vaporizes the fuel, as the fuel is drawn by capillary action to the flame. Candle wicks function by capillary action drawing a fuel from a pool up through a fabric, a thread wick, or a capillary tube. Examples of fuels include solid wax, gel, liquid wax or oil, polymer, oil lamps, and other devices meeting the preceding definition of candle.

During the end stages of the operative life of the candle, the pool of liquid fuel becomes shallow. The fuel in the shallow pool can become hot enough to vaporize and no longer needs the wick to burn. This phenomenon is called flash or flashover. Once the upper surface of the pool descends nearly to the bottom of the candle, the fuel can be elevated above its flashpoint temperature, typically about 425 degrees Fahrenheit with conventional, common fuels. During flashover, an ensuing candle fire may have a temperature elevated to at least 1200 degrees Fahrenheit. The high temperature can ignite vaporized fuel, and a container holding the candle may break violently due to uneven stress on the container caused by the build-up of excessive heat. If the candle has no container, then in the later stages of burning the candle the excessive heat can melt through the sides and bottom of the candle. Liquid fuel can flow onto and soak into surrounding objects and the candle-supporting surface. The fuel can ignite and combust the fuel-soaked surroundings, and a candle fire results.

A problem contributing to flashover and candle fires occurs when carbon particles fall into the pool of liquid fuel, or the user allows matches and wick trimmings to accumulate in the pool. These foreign objects may cause a candle fire by igniting to form secondary wicks. A secondary wick can float off the side of the candle and onto a flammable surface, or supplement the flaming wick to make a flame that is dangerously large.

Some problems resulting in flashover and candle fires, such as uncentered wicks and wicks that fall over, are addressed in conventional candles by using a wick support such as a sustainer. The sustainer provides support to a candle wick by retaining the wick in a passage formed completely through the sustainer. The sustainer keeps the wick standing upright as the previously supporting fuel around the wick becomes liquefied during burning.

As the conventional candle burns, liquid fuel is absorbed into the sides of the wick and carried upwardly to the flame. During the later stages of candle burning, as the upper surface of the pool of liquid fuel descends downwardly toward the top end of the sustainer, the heat from the flame liquefies the fuel surrounding the sustainer. The liquefied fuel flows into the passage opening at the bottom of the sustainer and into contact with the part of the wick that is in the sustainer. The fuel is drawn through the wick upwardly to the flame, which in this way consumes substantially all available fuel. During this process, flashover and candle fires can occur as the depth of the fuel pool decreases.

Flashover and candle fires are problems that cause significant damage and harm. Therefore a need exists for an inexpensive and simple safety measure for preventing or decreasing the likelihood of flashover and candle fires.

BRIEF SUMMARY OF THE INVENTION

The invention is a method of assembling and retaining a wick in a wick sustainer for a candle. The sustainer has a base, a barrel, and a passage extending through the base and the barrel. The wick is inserted into, and protrudes from, an upper region of the passage. A sealant is injected into a lower region of the passage. The sealant seals the passage at a point beneath the wick to prevent the fuel from contacting the wick within the sustainer and reaching the flame by capillary action through the wick. Additionally, the sustainer has a crimp to retain the wick mechanically.

The invention prevents flashover by being directed to a method for sealing the sustainer. Sealing the sustainer restricts fuel from flowing into the sustainer and contacting a part of the wick that is held within the sustainer. The seal causes the flame to be extinguished due to fuel-starvation once the surface of the pool descends below the top of the sustainer. Fuel reaches the candle flame only through the part of the wick that is not held within the sustainer.

Figure 1:
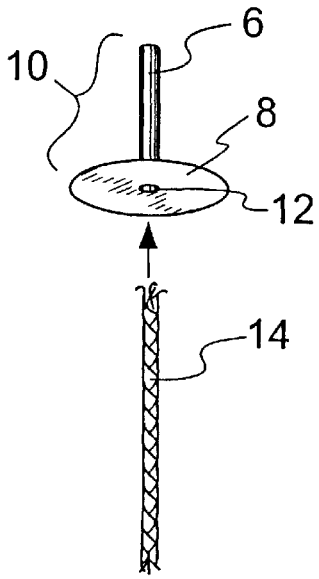
FIG. 1 is a view in perspective illustrating the first step of the preferred method.
Figure 2:
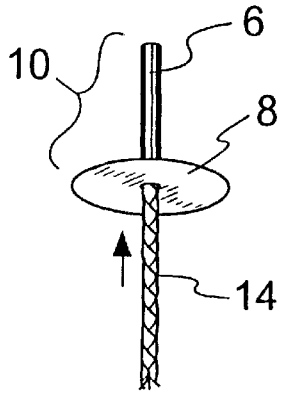
FIG. 2 is a view in perspective illustrating the second step of the preferred method.

In describing the preferred embodiment of the invention, which is illustrated in the drawings, specific terminology will be resorted to for the sake of clarity. However, it is not intended that the invention be limited to the specific term so selected, and it is to be understood that each specific term includes all technical equivalents that operate in a similar manner to accomplish a similar purpose.

DETAILED DESCRIPTION OF THE INVENTION

The steps of the inventive method are shown in FIGS. 1–18 and involve combining a wick 14 and a sealant 18 in a wick sustainer 10 for a candle by injecting the sealant 18 into the bottom of the wick sustainer 10. The wick sustainer 10 is a unitary structure that has an elongated barrel 6 and a perpendicular, planar base 8. The barrel 6 intersects the base 8 approximately at the base's center. A passage 12 extends longitudinally through the barrel 6 and the intersecting region of the base 8. The passage 12 has an upper region 11 and a lower region 13 defined by the position of the wick 14 as described below. The preferred sustainer is composed of a flame-resistant, rigid, liquid-impermeable metal such as steel or tin, but it may be ceramic, plastic, or other material having similar flame-resistant properties.

The preferred sustainer is described in U.S. Pat. No. 5,842,850 to Pappas, which is incorporated herein by reference. The sustainer 10 that is preferred for this method has an elongated barrel 6 of a length of about one-half inch or more, although the method disclosed is applicable for a sustainer having a barrel of any length. The standard wick sustainer commonly used in candles has a barrel that is shorter than the barrel 6 of the sustainer 10 used in the preferred method.

The wick 14 used in this method is the type commonly used in the industry. The standard wick is cord of tightly intertwined, woven fibers that may be fuel-coated. The wick 14 turns to ash as it burns, essentially disintegrating.

The sealant 18 used in the preferred method is flame-resistant and has a high softening point. The softening point is the temperature at which the sealant 18 loses enough structural integrity to substantially detach from the sustainer 10 and permit the passage 12 to become unsealed. The sealant 18 must resist softening when exposed to the heat of a candle flame, which is estimated to be 400 degrees Fahrenheit. If such temperatures are reached, then the sealant 18 is prevented from flowing out of the sustainer 10. More preferably, the sealant 18 resists softening when exposed even directly to the flame, which typically has a temperature of about 2100 degrees Fahrenheit. The sealant 18 that is preferred is flame-resistant hot-melt thermoplastic glue called MACROMELT TPX 16–157, manufactured by Henkel and distributed by Rudolph Brothers and Company, Canal Winchester, Ohio. Thermosetting materials may be used as an alternative to thermoplastics.

Figure 3:
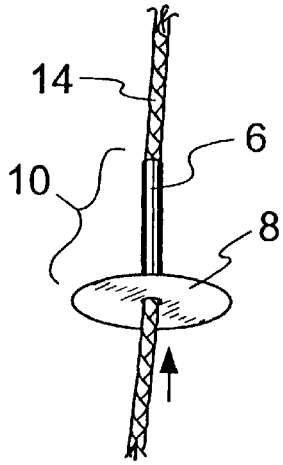
FIG. 3 is a view in perspective illustrating the third step of the preferred method.

FIG. 1 is an illustration showing the first step in the series of steps for performing the preferred method. A conventional candle wick 14 is pre-cut to a desired length, and its axis is aligned with the axis of the passage 12. In the next step shown in FIG. 2, the wick 14 is inserted into the passage 12. This insertion proceeds in the conventional manner until a predetermined length of the wick 14 protrudes from the upper region 11 of the passage, as shown in FIG. 3, and the wick 14 is in the desired position within the passage 12. Alternatively or additionally, the protruding length of the wick 14 can be grasped and pulled to position the wick 14 within the passage 12. Preferably, there is a space between the lower end of the wick 14 and the base 8 of the sustainer 10.

The lower region 13 of the passage 12 is the part that is unoccupied by the wick 14 and extends from the lower end of the wick 14 within the passage to the base 8 of the sustainer 10. The preferred length of the lower region 13 is in the range between one-eighth and one-fourth of an inch. The upper region 11 of the passage 12 is the part that the wick 14 occupies.

Figure 4:
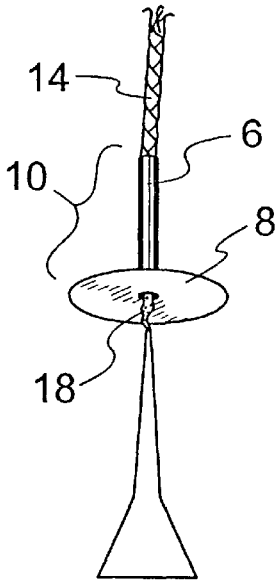
FIG. 4 is a view in perspective illustrating the fourth step of the preferred method.
Figure 5:
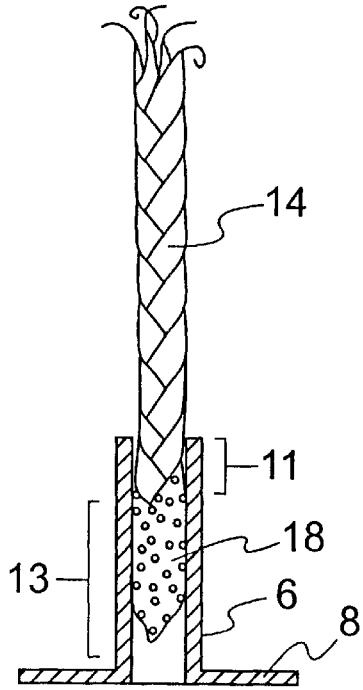
FIG. 5 is a side view in section illustrating the structure resulting after performing the fourth step of the preferred method, wherein the spacing is not to scale, but is exaggerated for illustrative purposes.
Figure 6:
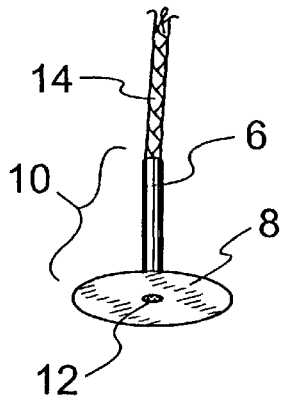
FIG. 6 is a view in perspective illustrating the structure resulting after performing the fourth step of the preferred method.

As shown in FIG. 4, after the wick 14 is positioned in the upper region 11, the next step is the injection of the sealant 18 from a hot-melt source into the lower region 13 where a gap was formed to make room for the sealant 18. As shown in FIG. 5, the amount of sealant 18 must be sufficient to bridge substantially entirely across the passage 12. Injecting an amount of the sealant 18 that forms a thin layer suspended across the entire passage 12, or an amount of the sealant 18 that completely fills the lower region 13, will suffice to block the passage 12 to substantially hinder the flow of fuel to the wick 14. The passage 12 need not be completely blocked to effect the desired starvation of the candle resulting in extinguishment of the flame. The sealant 18 needs to substantially seal the passage 12, which is defined as limiting the amount of fuel that can reach the wick 14, and therefore the flame, thereby resulting in flame extinguishment. FIG. 6 shows the resulting sustainer 10 that has a sealed passage 12.

The preferred sealant 18 has adhesive properties and adheres to the inner walls of the barrel 6. As shown in FIG. 5, an amount of sealant 18 injected into the passage 12 will preferably protrude from the lower region 13 into the upper region 11 and into adhesive contact with the wick 14. In this way, the sealant 18 adheres the wick 14 to the sustainer 10. The sustainer 10 must also often sit level on a flat surface in an operable position, and therefore the sealant 18 should not ordinarily protrude from the passage 12 at the base 8 so much that a glob is formed that causes the sustainer 10 to sit unevenly.

Figure 17:
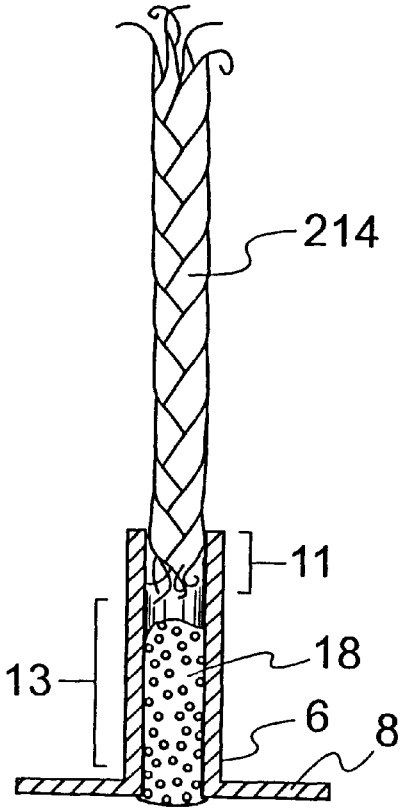
FIG. 17 is a side view in section illustrating the structure resulting after performing the alternative method shown in FIG. 16.

In an alternative embodiment shown in FIG. 17, an excess amount of the adhesive sealant 18 can be injected into the passage 12 and caused to protrude from the lower region 13.

The excess amount of adhesive sealant 18 protruding from the lower region 13 is useful for adhering the sustainer 10 to an interior bottom of a candle container such as when the sealant 18 is re-heated and softened prior to contacting the candle container.

The step of injecting the sealant 18 into the sustainer 10 seals the passage 12 to prevent, or at least substantially restrict, the flow of fuel into the passage 12 from the pool of liquid fuel at the bottom of the candle. Once the candle flame has burned for a period of time, the upper surface of the pool will no longer be above the top end of the sustainer 10. At this point the wick 14 no longer absorbs fuel through the sides of the wick 14, and the only path available to the fuel for reaching the flame is through the bottom of the sustainer 10. Sealing the sustainer 10 blocks this path, so the flame is extinguished due to fuel starvation. As a result, the pool cools and and flashover cannot occur.

The term injecting is used to mean more than merely inserting the sealant 18 into the sustainer 10 or applying the sealant 18 to the bottom of the sustainer 10 and pushing it into the passage 12. Injecting means to squirt a jet of sealant 18 under pressure from a nozzle or small orifice into the passage 12 of the sustainer 10. The preferred device for performing the sealing step in the method of FIG. 1 is an automated machine. The preferred machine is the Herrhammer EDP-250 Wicking Machine, by Herrhammer GmbH of Germany, with a faceplate removed to accommodate an automated hot sealant-injector. Alternatively, if a thermosetting sealant is used, the injector may not need to be heated. As an indexed wick sustainer 10 is processed through the machine in the conventional manner, the automated hot sealant-injector squirts sealant 18 into the passage 12 of the sustainer 10 at a later, new step. The sealant 18 is injected at the lower end of the passage 12. The tip of the sealant injector is removable, having a hexagonal shape to provide surfaces that a tool can grasp for removal for cleaning.

Figure 7:
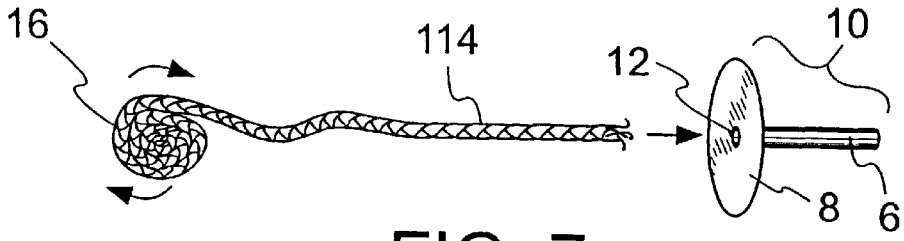
FIG. 7 is a view in perspective illustrating the first step of an alternative method.
Figure 8:
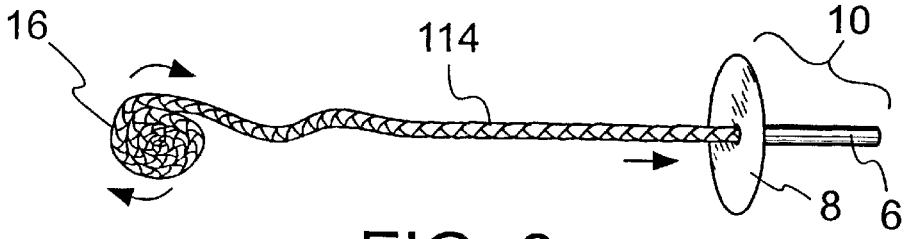
FIG. 8 is a view in perspective illustrating the second step of the alternative method.
Figure 9:
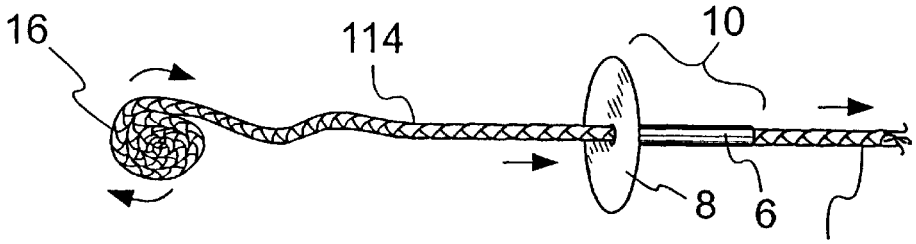
FIG. 9 is a view in perspective illustrating the third step of the alternative method.
Figure 10:
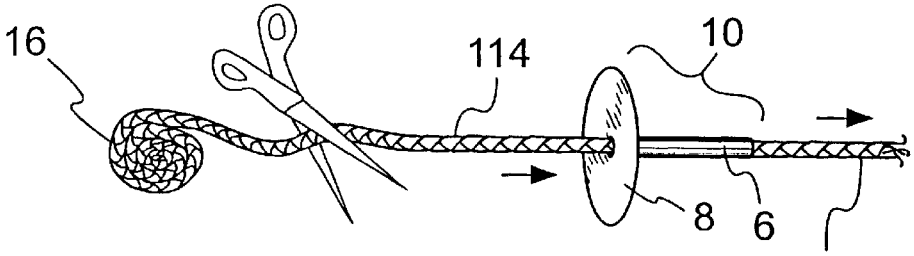
FIG. 10 is a view in perspective illustrating the fourth step of the alternative method.
Figure 11:
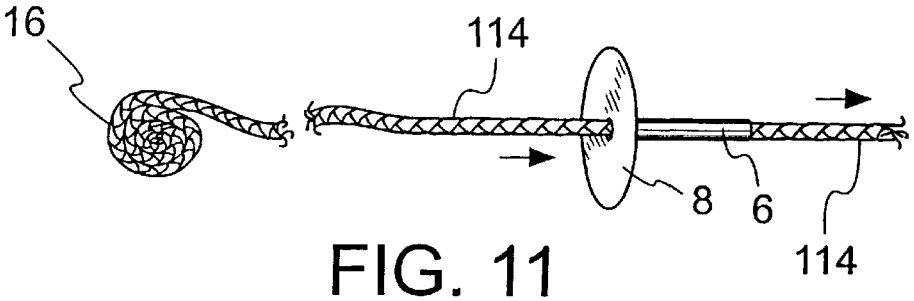
FIG. 11 is a view in perspective illustrating the fifth step of the alternative method.

FIG. 7 shows the first in a series of steps for performing the method in an alternative embodiment. The wick 114 is continuously drawn from a wick source 16, such as a roll or spool, and its axis is aligned with the axis of the passage 12. FIG. 8 shows the next step of inserting the wick 114 into the passage 12, and the insertion is continuous at least until an amount of the wick 114 protrudes from the opposite end of the barrel 6, as shown in FIG. 9. The steps in FIGS. 10 and 11 show drawing and severing of the wick 114 from the wick source 16. The point of severance depends on the desired final length for the wick 114.

Figure 12:
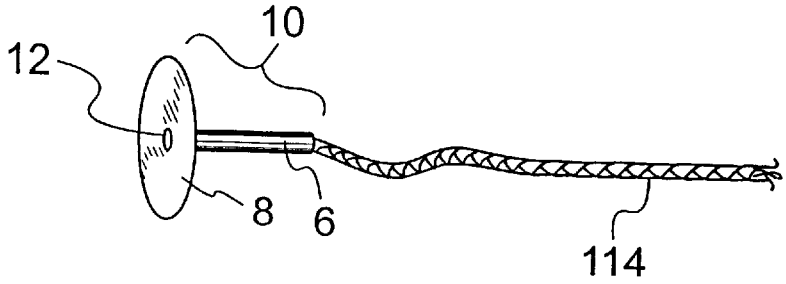
FIG. 12 is a view in perspective illustrating an intermediate structure formed after performing the fifth step of the alternative method.
Figure 13:
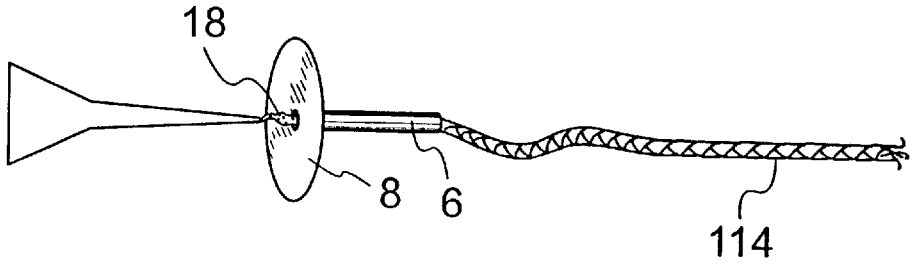
FIG. 13 is a view in perspective illustrating the sixth step of the alternative method.
Figure 14:
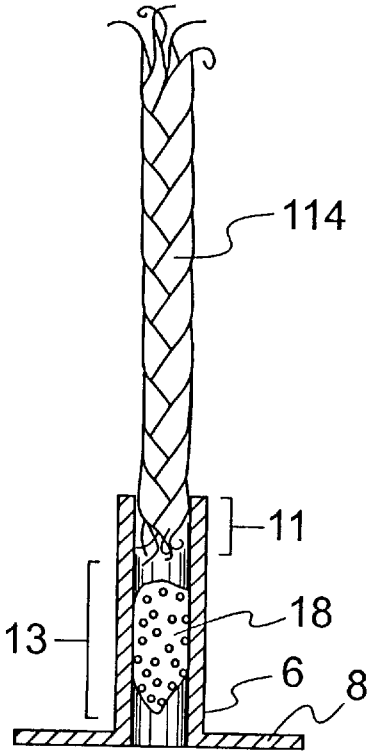
FIG. 14 is a side view in section illustrating the structure resulting after performing the sixth step of the alternative method.
Figure 15:
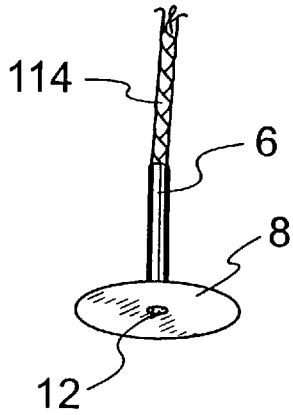
FIG. 15 is a view in perspective illustrating the structure resulting after performing the sixth step of the alternative method.

FIG. 12 shows the nearly completed structure having the wick 114 positioned within the passage 12 prior to injecting the sealant 18, which is illustrated in FIG. 13. A sectional view in FIG. 14 shows the sealant 18 and wick 114 placed within the passage 12, and FIG. 15 shows the structure with a sealed passage 12.

Figure 16:
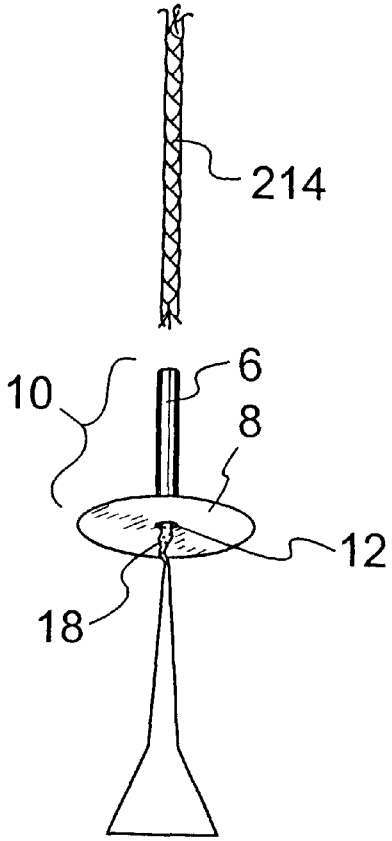
FIG. 16 is a view in perspective illustrating an alternative method.
Figure 18:
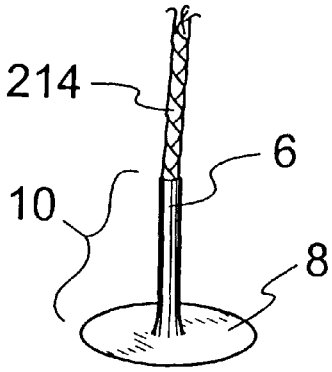
FIG. 18 is a view in perspective illustrating the structure shown in FIG. 17.

FIG. 16 illustrates the first step in an alternative method to make the structure shown in FIG. 18. The wick 214 is inserted into the passage 12 of the barrel 6 at the end opposite the base 8. FIG. 16 shows that the insertion of the wick 214 and injection of the sealant 18 into the barrel 6 can occur simultaneously. However, the sealant 18 may be injected prior or subsequent to inserting the wick 214.

In all embodiments, the sustainer 10 is crimped. After inserting the wick 14 into the upper region 11 of the passage 12, the further step of crimping the sustainer 10 in the upper region 11 pinches the walls of the passage 12 against the wick 14. Crimping enhances the mechanical support of the wick 14 by the upper region 11. Because the barrel 6 of the sustainer 10 is elongated, the crimp does not distort and bend the sustainer 10.

While certain preferred embodiments of the present invention have been disclosed in detail, it is to be understood that various modifications may be adopted without departing from the spirit of the invention or scope of the following claims.

What is claimed is:

1. A method of assembling and retaining a wick in a wick sustainer for a candle, the sustainer having a passage, the passage having an upper region and a lower region in an operable position of the sustainer, the method comprising:

(a) inserting the wick into the upper region of the passage of the sustainer to a position having the wick protruding from the sustainer at the upper region of the passage and leaving a space at the lower region of the passage unoccupied by the wick, and;

(b) injecting a sealant into the passage in at least a portion of the unoccupied space of the lower region, thereby extending the sealant across the passage and substantially sealing said passage.

2. The method of claim 1, wherein the sustainer has a barrel centrally mounted to and extending from a base and a passage through the barrel and the base and wherein the unoccupied space of the lower region extends through the base and the sealant is injected into the unoccupied space through the base.

3. The method of claim 1, wherein the unoccupied space of the lower region has a length in the range between about one-eighth and about one-fourth inches.

4. The method of claim 1, wherein the sealant has a softening point of at least 400 degrees Fahrenheit.

5. The method of claim 1, further comprising crimping the sustainer at the upper region of the passage to support the wick after inserting the wick into the upper region.

6. The method of claim 1, wherein the sealant is an adhesive.

7. The method of claim 6, wherein the sealant protrudes from the lower region into adhesive contact with the wick for adhering the wick to the sustainer.

8. The method of claim 6, wherein the sealant protrudes out of the lower region of the sustainer for adhering the sustainer to an interior bottom of a candle container.

9. The method of claim 1 wherein the sustainer has a barrel mounted to and extending from a base, the passage extending through the barrel and the base and the unoccupied space extends through the base and wherein:

(a) the sealant is an adhesive having a softening point of at least 400 degrees Fahrenheit and is injected through the base to seal the passage and extend out of the passage to permit adhering the sustainer to the interior bottom of a container candle; and (b) the sustainer is crimped at the upper region of the passage.

* * * * *